United States Patent [19]

Heck

[11] Patent Number: 4,705,195

[45] Date of Patent: Nov. 10, 1987

[54] VALVE APPARATUS FOR LIQUID DISPENSERS

[75] Inventor: Samuel C. Heck, San Antonio, Tex.

[73] Assignee: Sani-Fresh International, Inc., San Antonio, Tex.

[21] Appl. No.: 822,029

[22] Filed: Jan. 24, 1986

Related U.S. Application Data

[63] Continuation-in-part of Ser. No. 653,341, Sep. 20, 1984, abandoned, which is a continuation-in-part of Ser. No. 592,945, Mar. 23, 1984, Pat. No. 4,640,638, which is a continuation-in-part of Ser. No. 478,516, Mar. 24, 1983, Pat. No. 4,534,669.

[51] Int. Cl.[4] ..... B65D 37/00

[52] U.S. Cl. ..... 222/207; 222/209; 222/383; 137/533.11

[58] Field of Search ..... 137/533.11, 533.19, 137/512.2, 493.1; 401/134; 222/206, 207, 209, 212–213, 372, 378, 382–383, 464, 494, 500, 511, 518

[56] References Cited

U.S. PATENT DOCUMENTS

| | | | |
|---|---|---|---|
| 1,392,601 | 10/1921 | Rose | 222/207 |
| 1,600,095 | 9/1926 | Casaclang | 15/134 |
| 2,554,570 | 5/1951 | Harvey | 222/207 |
| 2,644,613 | 7/1953 | Pepin | 222/103 |
| 2,696,337 | 12/1954 | Dinhofer | 222/213 |
| 2,761,833 | 9/1956 | Ward | 222/207 X |
| 2,824,672 | 2/1958 | Wersching | 222/207 |
| 2,853,210 | 9/1958 | Stewart et al. | 222/207 |
| 2,987,743 | 6/1961 | Capps | 132/84 |
| 3,124,275 | 3/1964 | Lake | 222/207 X |
| 3,141,580 | 7/1964 | Rogers | 222/213 |
| 3,361,300 | 1/1968 | Kaplan | 222/133 |
| 3,390,821 | 7/1968 | Mullan | 222/212 |
| 3,506,162 | 4/1970 | Schwartzman | 222/207 |
| 3,541,581 | 11/1970 | Monson | 252/90 |
| 3,550,817 | 12/1970 | Babin | 222/207 |
| 3,788,753 | 1/1974 | Stewart | 401/134 |
| 3,828,985 | 8/1974 | Schindler | 222/207 |
| 3,841,349 | 10/1974 | Todd | 137/513.5 X |
| 4,084,731 | 4/1978 | Ayres | 222/380 |
| 4,098,434 | 7/1978 | Uhlig | 222/94 |
| 4,102,476 | 7/1978 | Loeffler | 222/209 |
| 4,120,429 | 10/1978 | Vignot | 222/207 |
| 4,137,955 | 2/1979 | Carlson | 141/349 |
| 4,153,182 | 5/1979 | Loeliger | 222/95 |
| 4,168,020 | 9/1979 | Benson | 222/207 |
| 4,245,760 | 1/1981 | Stevenson et al. | 222/148 |
| 4,336,895 | 6/1982 | Aleff | 222/207 |
| 4,345,718 | 8/1982 | Horvath | 239/333 |
| 4,407,435 | 10/1983 | Harmon | 222/481 |
| 4,457,454 | 7/1984 | Meshberg | 222/95 |
| 4,489,857 | 12/1984 | Batlas | 222/179 |

FOREIGN PATENT DOCUMENTS

| | | | |
|---|---|---|---|
| 2440684 | 3/1976 | Fed. Rep. of Germany | 137/533.11 |
| 57-38681 | 3/1982 | Japan . | |

*Primary Examiner*—Joseph J. Rolla
*Assistant Examiner*—Michael S. Huppert
*Attorney, Agent, or Firm*—Joseph H. Yamaoka; John W. Kane, Jr.

[57] ABSTRACT

A liquid dispenser. The liquid dispenser includes a pump chamber connected to a storage chamber through a first passage. A valve body extends through the first passage and controls the liquid flow around the valve body and between the pump chamber and the storage chamber. The valve body provides a second internal connecting passage between the pump chamber and the storage chamber and an additional valve located within the valve body controls the flow of liquid between the pump chamber and storage chamber through the second internal connecting passage.

7 Claims, 6 Drawing Figures

VALVE APPARATUS FOR LIQUID DISPENSERS

The present application is a continuation-in-part of U.S. patent application Ser. No. 653,341, filed Sept. 20, 1984, now abandoned entitled CLEANING SYSTEM HAVING COLLAPSIBLE CARTRIDGE, which application is a continuation-in-part of U.S. patent application Ser. No. 592,945, filed Mar. 23, 1984, now U.S. Pat. No. 4,640,638, entitled CLEANING SYSTEM, which application is a continuation-in-part of U.S. patent application Ser. No. 478,516 filed Mar. 24, 1983, now U.S. Pat. No. 4,534,669, entitled CLEANING SYSTEM WITH CARTRIDGE HAVING VALVE MEANS. The disclosure of U.S. Patent application Ser. No. 653,341, filed Sept. 20, 1984, entitled CLEANING SYSTEM HAVING COLLAPSIBLE CARTRIDGE is incorporated herein by reference.

BACKGROUND OF THE INVENTION

The present invention relates to a valve apparatus for use within a liquid dispenser.

The present invention is directed to solving a problem which may occur as a result of the use of another type of valve in a liquid dispenser having a storage chamber and pump chamber, the valve being located within a passage intermediate the storage chamber and pump chamber, and the liquid to be dispensed being present only in the storage chamber. When the liquid dispenser is turned upside down or tilted downward, such as when the dispenser is used in a cleaning wand, flow of liquid into the pump chamber past the valve may be impeded. This problem is apparently caused by a small vacuum in the storage chamber and has heretofore been solved by priming or initially pumping the pump chamber once the dispenser is tilted downward or by simply filling the storage chamber and a portion of the pump chamber with the liquid to be dispensed. The former solution requires an additional pumping step while the latter solution requires that the dispenser be filled with a greater amount of liquid than would normally be desired.

SUMMARY OF THE INVENTION

Accordingly, the present invention provides a valve apparatus for liquid dispensers which may be located in a passage intermediate a storage chamber and a pump chamber. Such placement within a liquid dispenser eliminates the necessity of priming or initially pumping the pump chamber once the dispenser is tilted downward. The valve apparatus of the present invention also eliminates the necessity of filling the dispenser with more liquid than is desired.

The valve apparatus comprises a valve body having a plurality of external ribs having undercuts therein, an outwardly extending tube on one end thereof, and a lip on the opposite end thereof. A plurality of internal ribs having undercuts therein retain a ball within a passage within the valve body. A plurality of integral projections extend upward from the lip. The valve apparatus essentially comprises a check valve having a ball valve therein.

When the valve apparatus is placed within a liquid dispenser in the passage intermediate the pump chamber and storage chamber and the dispenser is tilted downward, air will pass from the pump chamber into the storage chamber through the passage in the valve body, thereby breaking the vacuum in the storage chamber and permitting flow of liquid into the pump chamber. As a result of the extension of the valve body tube into the storage chamber, the vertical distance between the lowest point at which liquid can pass from the storage chamber into the pump chamber and the highest point at which air from the pump chamber can pass into the storage chamber is much greater than with another type of valve, thereby facilitating passage of air into the storage chamber and passage of liquid into the pump chamber.

DETAILED DESCRIPTION OF THE PREFERRED EMBODIMENT

Figure 1:
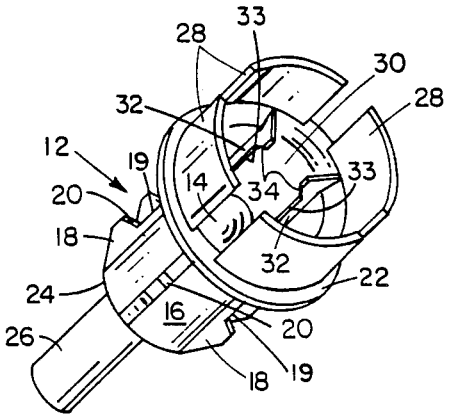
FIG. 1 is a perspective view of a preferred embodiment of a valve apparatus for liquid dispensers.

The preferred embodiment of the valve apparatus of the pesent invention is illustrated in FIG. 1. The valve apparatus comprises an integral valve body 12 having an acid resistant ball 14 therein. The valve body 12 comprises a substantially cylindrical side wall 16 having a plurality of integral, external ribs 18 extending outward therefrom along the length thereof. Each rib 18 has an undercut 19 therein and is provided with an abutment shoulder 20. The valve body 12 is further provided with an integral, substantially circular lip or shoulder 22 on one end of side wall 16 and an integral base 24 on the opposite end of side wall 16. An integral, substantially cylindrical tube 26 extends downward from base 24 and a plurality of integral projections 28 extend upward from lip 22.

Figure 3:
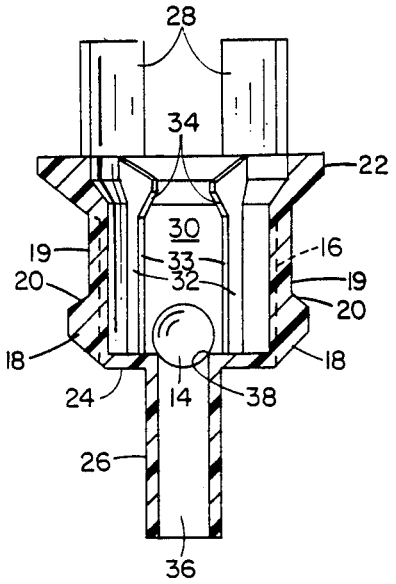
FIG. 3 is a cross-sectional view taken along section lines 3—3 of FIG. 2 of a preferred embodiment of a valve apparatus for liquid dispensers.
Figure 2:
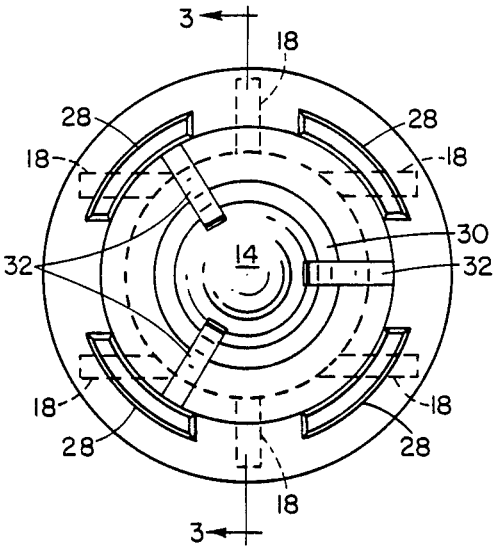
FIG. 2 is a top view of a preferred embodiment of a valve apparatus for liquid dispensers.

As illustrated in FIG. 2 and FIG. 3, the ball 14 is retained within a passage or cavity 30 defined by side wall 16 by means of a plurality of integral, internal ribs 32 having undercuts 33 therein and abutment shoulders 34. Ribs 32 extend into passage 30 along the length of side wall 16 and are spaced approximately on hundred and twenty degrees (120°) from each other. As illustrated in FIG. 3, a passage 36 also extends through tube 26 in fluid communication with passage 30 through port 38.

Figure 4:
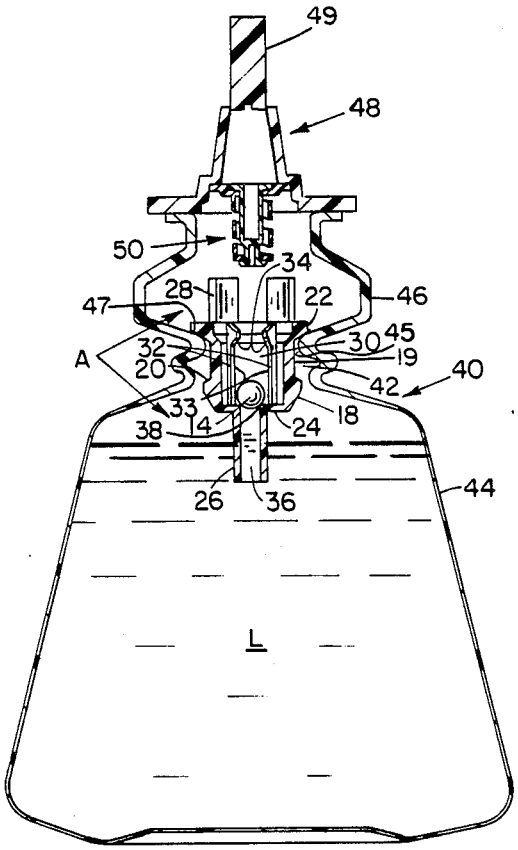
FIG. 4 is a cross-sectional view of a preferred embodiment of a valve apparatus for liquid dispensers illustrated within a passage intermediate a storage chamber and a pump chamber of a liquid dispenser which is upright.

Referring to FIG. 4, the valve apparatus of the present invention is illustrated within a liquid dispenser 40 which is partially filled with a liquid L and air A. The valve apparatus is disposed within a passage 42 intermediate a storage chamber 44 and a pump chamber 46. The valve apparatus is normally maintained within the dispenser passage 42 in a snap fit by means of lip 22 and shoulders 20. The dispenser 40 may also be provided with a nozzle member 48 which is connected to the uppermost end of pump chamber 46 and has a spring biased check valve 50 mounted therein. Nozzle member 48 preferably has a solid closure tip 49 which may be broken off prior to usage of the dispenser 40, as illustrated in FIG. 5 and FIG. 6.

The liquid dispenser 40 illustrated in FIG. 4, with the valve apparatus mounted therein, is in the preprimed stage or storage position. In this stage, air A is present in the storage chamber 44 and pump chamber 46. Further, the ball 14 rests within the valve seat defined by base 24 and port 38, thereby sealing port 38. The valve apparatus is supported within passage 42 by valve body lip 22 which is supported by substantially circular pump chamber shoulder 47.

Figure 5:
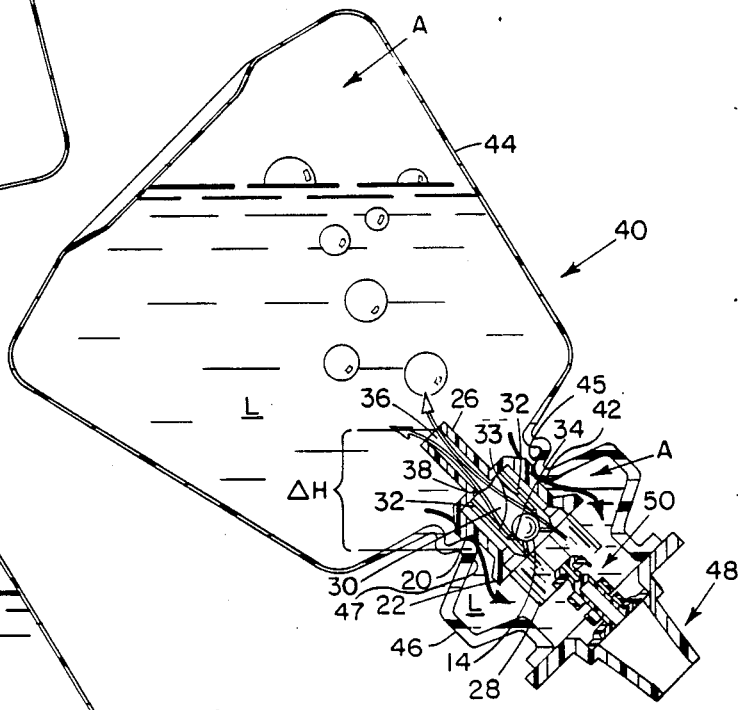
FIG. 5 is a cross-sectional view of a preferred embodiment of a valve apparatus for liquid dispensers illustrated within a passage intermediate a storage chamber and a pump chamber of a liquid dispenser which is tilted downward.
Figure 6:
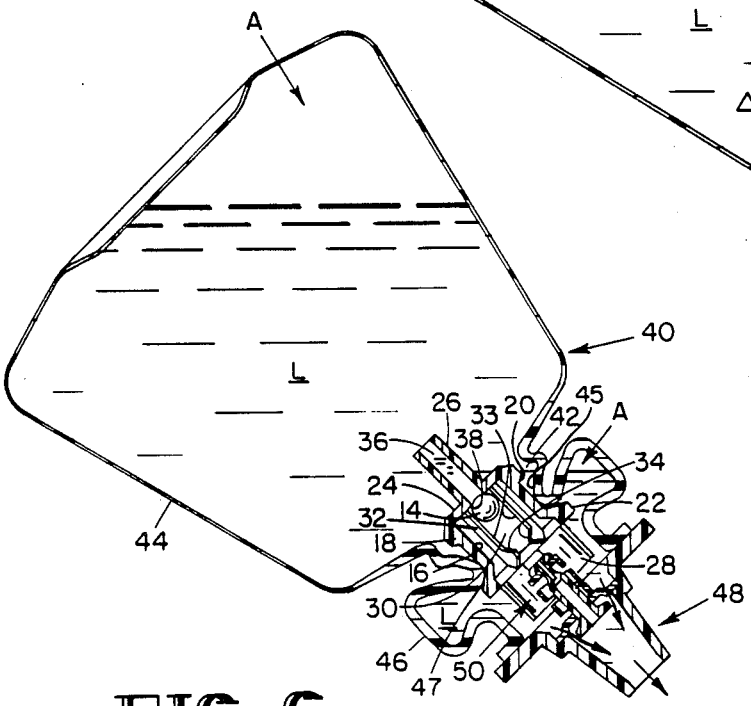
FIG. 6 is a cross-sectional view of a preferred embodiment of a valve apparatus for liquid dispensers illustrated within a passage intermediate a storage chamber and a pump chamber of a liquid dispenser which is tilted downward and wherein the pump chamber is being pumped.

When the liquid dispenser 40 is tilted downward, as illustrated in FIG. 5, the liquid dispenser 40 and valve apparatus assume the primed position or stage. In the primed stage, ball 14 moves toward the opposite end of the valve apparatus and is retained within passage 30 by internal shoulders 34, thereby opening port 38. The valve apparatus will also move toward nozzle member 48 and be supported within passage 42 by external rib shoulders 20 which are supported by substantially circular storage chamber shoulder 45.

It is to be understood that when dispenser 40 is initially tilted downward from the position shown in FIG. 4 to the position shown in FIG. 5, air A from within the pump chamber 46 will pass through passage 30, port 38, and passage 36 into storage chamber 44, as illustrated by the clear arrows and bubbles in FIG. 5. Once air A enters the storage chamber 44 from pump chamber 46, the small vacuum within the storage chamber 44 will be broken and a portion of the liquid L within storage chamber 44 will thereafter pass into pump chamber 46 through passage 42, as illustrated by the solid arrows in FIG. 5. Once the vacuum is broken, the ready transfer of liquid L from the storage chamber 44 into the pump chamber 46 and simultaneous transfer of air A from the pump chamber 46 into the storage chamber 44 is facilitated by the vertical distance or head delta H, illustrated in FIG. 5, defined by the vertical distance between the lowest point that liquid L can enter the pump chamber 46 and the highest point that air A can enter the storage chamber 44. Further, the vacuum within the storage chamber 44 will remain broken provided the dispenser 40 remains tilted downward, as illustrated in FIG. 5. However, air A will utlimately cease passing into storage chamber 44 and a portion of air A may remain within pump chamber 46, as further illustrated in FIG. 5.

During the subsequent pumping or compression of the pump chamber 46, as illustrated in FIG. 6, liquid L will be urged outward from the pump chamber 46 through check valve 50 and nozzle member 48, as illustrated by the solid arrows in FIG. 6. The ball 14 will be urged rearward within passage 30 to again seal port 38. The valve apparatus will likewise seal passage 42 by means of the abutment of lip 22 against pump chamber shoulder 47. When the pumping stage is finished, the valve apparatus and dispenser 40 will return to the position shown in FIG. 5, with the pump chamber 46 again being filled or partially filled with liquid L, as illustrated by the solid arrows in FIG. 5.

The plastic valve body 12 is preferably molded in a conventional manner with the body 12 ejected off the core in a manner which utilizes the flexibility of the body 12 to ramp out of the undercuts without tearing or breaking the body 12. The plastic or glass ball 14 is thereafter inserted into the body 12. The purpose of projections 28 is to abut against nozzle member 48 in the event the dispenser 40 is dropped, thereby prohibiting hydraulic forces from urging the valve apparatus outward from passage 42.

It is to be understood that the valve apparatus of the present invention essentially comprises a check valve having a ball valve therein which permits flow of liquid in one direction and separate, independent flow of gas in the opposite direction. It is also to be understood that when the valve apparatus of the present invention is placed within a passage 42 intermediate a storage chamber 44 and a pump chamber 46, as illustrated in FIG. 4, the dispenser 40 will be automatically primed when dispenser 40 is tilted downward, as illustated in FIG. 5. Finally, it is to be understood that ball 14 will seal port 38 during the pumping stage, as illustrated in FIG. 6, but will allow port 38 to open in the primed stage, as illustrated in FIG. 5.

In the preferred embodiment, tube 26 has an outer diameter of approximately 0.236 inches and an inner diameter of approximately 0.156 inches, side wall 16 has an outer diameter of approximately 0.445 inches and an inner diameter of approximately 0.375 inches, lip 22 has an outer diameter of approximately 0.670 inches, and ball 14 has a diameter of approximately 0.25 inches. Further, tube 26 preferably has a length of approximately 0.345 inches and side wall 16 preferably has a length of approximately 0.440 inches from tube 26 to lip 22 (including lip 22). Finally, projections 28 preferably have a length of approximately 0.265 inches. In the preferred embodiment, the valve apparatus has six (6) external ribs 18, three (3) internal ribs 32, and four (4) projections 28.

While the valve apparatus for liquid dispensers has been described in connection with the preferred embodiment, it is not intended to limit the invention to the particular form set forth, but on the contrary, it is intended to cover such alternatives, modifications, and equivalents, as may be included within the spirit and scope of the invention as defined by the appended claims.

I claim:

1. A liquid dispenser comprising:

(a) a storage chamber;

(b) a pump chamber having one end connected to the storage chamber through a first passage and having at its other end an outlet orifice for discharging liquid from the dispenser;

(c) a valve body extending through and cooperating with the first passage, the valve body having a first position which allows liquid to flow around the valve body and between the pump chamber and the storage chamber and having a second sealing position that prevents liquid flow around the valve body and between the pump chamber and the storage chamber, said valve body having a means for blocking liquid flow in said second sealing position and an internal connecting passage between the pump chamber and the storage chamber; and (d) valve means located within the valve body having a first position that allows liquid to flow through the internal connecting passage between the pump chamber and the storage chamber and a second sealing position that prevents liquid flow through the internal connecting passage.

2. A liquid dispenser as recited in claim 1 further comprising a valve in the outlet orifice for controlling the flow of liquid out of the dispenser.

3. A liquid dispenser as recited in claim 1 wherein the valve means located within the valve body is a ball valve.

4. A liquid dispenser as recited in claim 1 wherein the internal passage is through a tubular portion of the valve body extending into the storage chamber so that when the dispenser is oriented with the storage chamber above the pump chamber, the vetical distance between the end of the tubular portion extending into the storage chamber and the lowest point of the first passage is greater than the vertical distance between the highest and lowest points of the first passage.

5. A liquid dispenser as recited in claim 4 further comprising a valve in the outlet orifice for controlling the flow of liquid out of the dispenser.

6. A liquid dispenser as recited in claim 5 wherein the valve means located within the valve body is a ball valve.

7. A liquid dispenser as recited in claim 6 wherein the valve in the outlet orifice is a spring biased check valve.

* * * * *